US008550796B2

(12) United States Patent
Codeca et al.

(10) Patent No.: US 8,550,796 B2
(45) Date of Patent: Oct. 8, 2013

(54) VARIABLE CAPACITY FLUIDIC MACHINE

(75) Inventors: Armando Codeca, Offanengo (IT); Matteo Cortesi, Offanengo (IT); Franco Fermini, Offanengo (IT)

(73) Assignee: VHIT S.p.A., Offanengo (CR) (IT)

( * ) Notice: Subject to any disclaimer, the term of this patent is extended or adjusted under 35 U.S.C. 154(b) by 124 days.

(21) Appl. No.: 13/264,266

(22) PCT Filed: Apr. 14, 2010

(86) PCT No.: PCT/IB2010/051621
§ 371 (c)(1),
(2), (4) Date: Dec. 6, 2011

(87) PCT Pub. No.: WO2010/119411
PCT Pub. Date: Oct. 21, 2010

(65) Prior Publication Data

US 2012/0107162 A1 May 3, 2012

(30) Foreign Application Priority Data

Apr. 15, 2009 (IT) ..... TO2009A0290

(51) Int. Cl.
*F04B 49/00* (2006.01)
*F04C 14/18* (2006.01)

(52) U.S. Cl.
USPC ..... 418/26; 417/410.4; 417/212; 418/21; 418/28

(58) Field of Classification Search
USPC ..... 417/212, 274, 410.4; 418/21, 28, 26, 418/206.1
See application file for complete search history.

(56) References Cited

U.S. PATENT DOCUMENTS

| | | | | |
|---|---|---|---|---|
| 4,740,142 | A | 4/1988 | Rohs et al. | |
| 4,812,111 | A * | 3/1989 | Thomas | 418/20 |
| 5,620,315 | A * | 4/1997 | Pfuhler | 418/21 |
| 6,244,839 | B1 * | 6/2001 | Cole et al. | 418/21 |
| 7,195,467 | B2 * | 3/2007 | Cadeddu | 418/21 |
| 7,588,431 | B2 * | 9/2009 | O'Brien, II | 418/206.1 |
| 7,832,997 | B2 * | 11/2010 | Williamson et al. | 418/61.3 |

FOREIGN PATENT DOCUMENTS

| | | | |
|---|---|---|---|
| CH | 216 223 | A | 8/1941 |
| DE | 102 37 801 | A1 | 7/2003 |
| GB | 2 440 342 | A | 1/2008 |

* cited by examiner

*Primary Examiner* — Devon Kramer
*Assistant Examiner* — Nathan Zollinger
(74) *Attorney, Agent, or Firm* — Sughrue Mion, PLLC

(57) ABSTRACT

An internal gear fluidic machine, in particular a pump for the lubrication circuit of a motor vehicle engine, comprises an operating part including an external gear (2) and an internal gear (4), which is housed within an axial cavity (25) of the external gear (2) and meshes with the latter. The external gear (2) is associated with a translating mechanism (8, 22), arranged to cause an axial sliding thereof relative to the internal gear (4) in order to vary the capacity and the fluid flow rate of the machine. The translating mechanism (8, 22) defines a first capacity, adjustment space (24) in communication with a high pressure chamber (48) of the machine, and a second capacity adjustment space (15) where pressure conditions exist that are dependent on the operating conditions of an element, different from the high pressure chamber (48), of a fluidic circuit in which the machine (1) is connected. The translating mechanism (8, 22) causes the sliding of the external gear (2) in response to the pressure conditions existing in the first or the second capacity adjustment spaces (24, 15), or in response to the combination of the pressure conditions existing in both spaces. The invention also concerns a method of varying the capacity of an internal gear fluidic machine.

20 Claims, 4 Drawing Sheets

VARIABLE CAPACITY FLUIDIC MACHINE

CROSS REFERENCE TO RELATED APPLICATIONS

This application is a National Stage of International Application No. PCT/IB2010/051621, filed on Apr. 14, 2010, which claims priority from Italian Patent Application No. TO2009A00290, filed Apr. 15, 2009, the contents of all of which are incorporated herein by reference in their entirety.

The present invention relates to fluidic machines, and more particularly it concerns an internal gear fluidic machine, in particular a pump, with variable capacity.

Preferably, but not exclusively, the present invention is applied in a pump for the lubrication oil of a motor vehicle engine.

In several technical applications, for example in order to have lubrication oil circulate under pressure in motor vehicle engines, positive displacement internal gear pumps are often used. These pumps generally comprise: a fixed body; an external orbital to gear rotating in said body about a first rotational axis and having an internal toothing; an internal orbital gear rotating inside the external orbital gear about a second axis, different from the first one, and having an external toothing meshing with the internal toothing of the external orbital gear with only partial hydraulic seal; a transmission member, generally driven by the vehicle engine, in order to impart the rotation to one of the two orbital gears, which in turn brings the other into rotation due to the meshing of the respective toothings. The toothings, which have a different number of teeth, define a succession of variable volume chambers among them, and oil is conveyed from an intake port to a discharge port through said chambers.

In such pumps the capacity, and hence the oil flow rate at the outlet, depends on the rotation speed of the engine, and therefore the pumps are designed so as to provide a sufficient flow rate at low speed, in order to ensure lubrication also in such conditions. If the pump has a fixed geometry, at high rotation speed the flow rate is higher than that required, resulting in an unnecessary energy consumption and, finally, in an increase in fuel consumption.

Similar problems are encountered in pneumatic pumps or when the above structure is used as a motor, either hydraulic or pneumatic.

In order to reduce the performance variability as the operating conditions change, and to obviate the above drawbacks, variable capacity fluidic machines have already been proposed, in which the variation of the flow rate is obtained by varying the axial extension of the engagement region between both orbital gears.

A first example is disclosed in JP 56020788. In such a solution, the capacity adjustment is obtained by translating the orbital gear driven by the motor: the coupling between the rotational movement of the pump and the translational movement for the capacity adjustment results in a high absorbed torque, which limits the advantages resulting from the capacity adjustment.

Another example is the pump disclosed in WO 2004/003345. In this pump, the rotational and translational movements are separated, in that the rotational movement is transmitted to one of the orbital gears and the capacity is varied by means of a translation of the other orbital gear, so that the problem of the high absorbed torque is solved. However, a problem with this prior art pump is that the capacity adjustment is based only on the control of the pressure in a space communicating with the delivery chamber. Under these conditions, also an overpressure occurring upstream of the main control channel of the engine would be considered as being due to a high rotation speed and would consequently lead to a reduction in the oil flow rate, with risks of damaging the engine because of an insufficient lubrication.

Moreover, in this prior art pump, the translation of the orbital gear is not obtained directly, but indirectly, thanks to a small piston which slides as the fluid pressure changes and causes the translation of the external orbital gear. This makes the pump structure more complex and its reaction slower.

Document GB 2 440 342 discloses a pump having a substantially star-shaped internal ring providing an axially directed feed. Such an internal ring has a plurality of drill ways connecting the pumping chambers with the inlet and outlet ports depending on the angular position of the internal ring. The device of said document has some drawbacks.

A first drawback is that the drill ways must have reduced transversal cross-sectional sizes in order to ensure the required structural strength of the internal ring. Yet, reducing the transversal cross-sectional sizes of the drill ways has the drawback of entailing cavitation problems at high rotation speeds of the pump.

A further drawback is that, in order to increase the pump displacement, it is necessary to correspondingly increase the axial sizes of the inlet and outlet ports, whereby the pump is made significantly bulky in axial direction. The great axial size can originate problems for mounting the pump, which generally is housed in the bottom part of the engine. For instance, if the axial size of the pump increases, the risk exists of interfering with the proper movement of the camshaft.

It is an object of the present invention to provide a hydraulic machine with gears, which obviates the drawbacks of the prior art.

According to the invention, this is obtained in that a translating mechanism, causing the sliding of the axially displaceable orbital gear, defines, besides the space in communication with the high pressure chamber of the machine, a second capacity adjustment space where second pressure conditions exist that are dependent on operating conditions of an element, different from the high pressure chamber, of a fluidic circuit in which the machine is connected, and the translating mechanism is axially slidable in the supporting part either in response also to the pressure conditions existing in the second capacity adjustment space, or in response to a combination of the pressure conditions existing in both adjustment spaces.

Advantageously, the axially slidable gear is made as an integral part of the translating mechanism.

In the preferred case of use of the machine as a pump for the lubrication oil of a motor vehicle engine, the first adjustment space is in communication with a delivery side of the pump. Moreover, in a first embodiment, the second adjustment space receives lubrication fluid under pressure sent back from the engine to the pump, and in a second embodiment, in which the capacity of the machine is established by an external management logic responsive to the operating conditions of the engine, when the pump is made to operate at its maximum capacity the second adjustment space is in communication with the oil sump in order to discharge to the latter oil leaks, if any, occurring in the pump, and when the pump is made to operate at a lower capacity than the maximum capacity such space is in communication with the delivery side of the pump.

In further advantageous manner, differently from what disclosed in GB 2 440 342, the pump according to the present invention allows implementing a radially directed feed, by means of openings defined by cuts that can be made with sizes adjustable depending on the manufacturing requirements.

Consequently, it is possible to freely dimension the transverse cross-sectional sizes of the openings so as to avoid cavitation problems in the pump.

Another advantage of the pump according to the present invention is that the displacement can be increased by increasing the radial sizes of an external orbital gear, an internal orbital gear and a toothed portion of a star-shaped cap belonging to such a pump. Thus, the increase in the displacement does not negatively affect the axial size of the pump, differently from what occurs instead in GB 2 440 342.

Also provided is a method of varying the capacity of an internal gear fluidic machine. According to the method, a first capacity adjustment space communicating with a high pressure chamber of the machine is created, and the capacity of the machine is varied by making one of both gears of the machine axially slide relative to the other, in response to first pressure conditions existing in the first capacity adjustment space, in order to change the extension of an area over which the teeth of both gears mesh. The method further comprises: creating a second capacity adjustment space; establishing in the second space second pressure conditions that are dependent on operating conditions existing in an element, different from the high pressure chamber, of a fluidic circuit in which the machine is connected; and making the slidable gear axially slide either in response also to the pressure conditions existing in the second capacity adjustment space, or in response to a combination of the pressure conditions existing in both capacity adjustment spaces.

The invention will be described now in further detail with reference to the accompanying drawings, which show a preferred embodiment given by way of non-limiting example and relating to the use of the invention as a pump for the lubrication oil of a motor vehicle engine, and in which.

Figure 1:
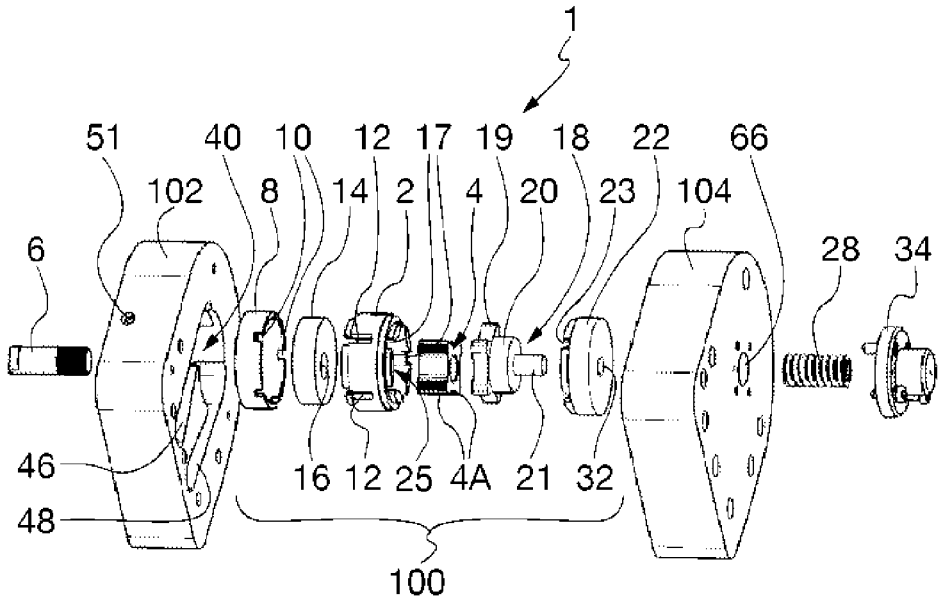
FIG. 1 is an exploded view of the pump according to the invention.
Figure 2:
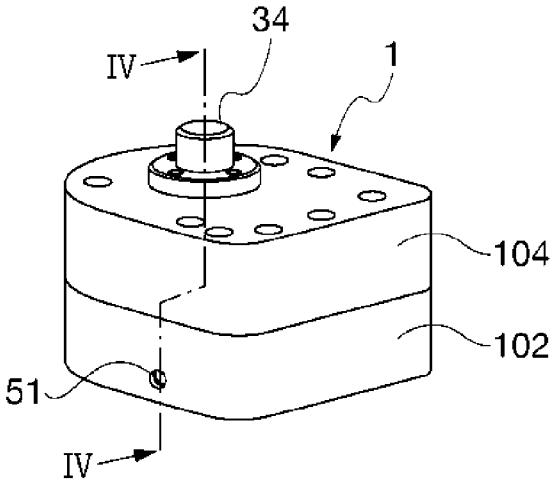
FIG. 2 is a perspective view of the pump shown in FIG. 1, in assembled condition.

The following description, by way of example only and for the sake of clarity and simplicity of the description, will refer to a pump arranged with vertical axis and driven from the bottom, and the terms "upper", "lower", "top", "bottom" and so on are therefore referred to such an orientation.

Referring to FIGS. 1 to 5, the pump according to the invention, generally denoted 1, is substantially a positive displacement internal gear pump, comprising an operating part or central body 100 and a supporting part, consisting of a first body (lower body) 102 and a second body (upper body) 104, between which operating part 100 is enclosed.

Operating part 100 comprises, in conventional manner, a first gear 2 (external orbital gear) having an internal toothing, e.g. with five teeth 2A (FIG. 5), and a second gear 4 (internal orbital gear), which is received in axial cavity 25 of external orbital gear 2 and has an external toothing, e.g. with four teeth 4A, meshing with the toothing of external orbital gear 2 with only partial hydraulic seal. Internal orbital gear 4 is mounted on a pump shaft 6 (for instance driven directly or through a suitable transmission system by the motor vehicle engine), is made to rotate by said shaft about a first axis coinciding with the axis, of shaft 6, and brings external orbital gear 2 into rotation about a second axis, parallel to the first one. The teeth of both gears define chambers 11 (FIG. 4) the volume of which changes during rotation and though which oil is compressed while being transferred from an intake side to a delivery side of pump 1. The axial extension of the region over which the teeth of both gears mesh determines the capacity or displacement of the pump, and hence the flow rate of the oil leaving the pump.

External orbital gear 2 is mounted so as to be axially slidable relative to internal orbital gear 4 in order to vary the pump capacity as the operating conditions vary, in particular in order to reduce such a capacity, and hence the flow rate of the oil, at high rotation speeds. As it will be described in greater detail below, the adjustment can be controlled either by the pressure actually existing in the engine, or by the pressure inside the pump (delivery pressure). This allows safeguarding the integrity of the whole lubrication system and avoiding flow rate reductions in case of pressure increases due to anomalous conditions and not to an actual increase in the rotation speed. Moreover, since one of the orbital gears is made to rotate by shaft 6 and the capacity is adjusted by means of a translation of the other orbital gear, the pump rotational movement is decoupled from the capacity adjustment, with a consequent reduction of the absorbed torque with respect to solutions in which the same orbital gear performs both movements.

External orbital gear 2 is rigidly connected for the rotational and translational movements to an external ring 8, mounted with interference on the bottom end of external orbital gear 2 so as to abut against a step 7 of the surface thereof. In correspondence with the coupling region of external orbital gear 2 and ring 8, the edges of such elements are provided with cuts 12 on external orbital gear 2 and cuts 10 on ring 8, respectively, defining openings 13 (FIG. 13) for oil inlet/outlet into/from chambers 11. When the pump is assembled, external ring 8 is received within a cavity 40 of lower body 102. As the skilled in the art can appreciate by reading the above description and by looking at the accompanying drawings, cuts 10 and 12 define radially oriented openings 13, so that a radial feed of the pump is obtained.

Figure 4:
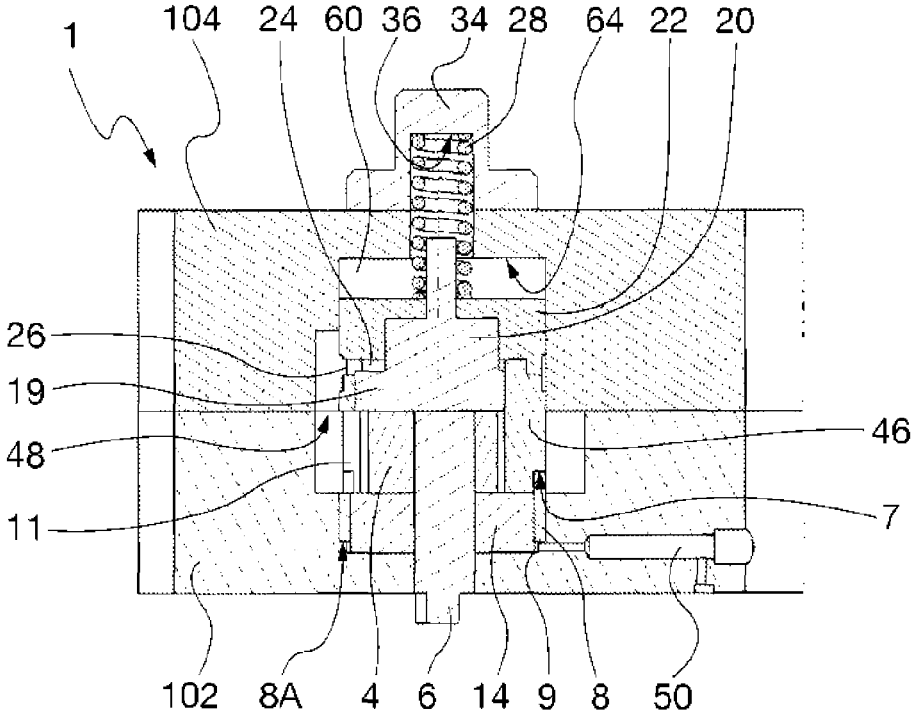
FIG. 4 is a cross-sectional view of the pump, taken along line IV-IV of FIG. 2, in conditions of maximum capacity of the pump.

A first cap (lower cap) 14 is housed inside ring 8 and both the bottom base of external orbital gear 2 in conditions of maximum capacity of the pump, and the bottom base of internal orbital gear 4, abut against the top surface of the cap, as shown in FIG. 4. Cap 14 is mounted in axially fixed position, and ring 8 and external orbital gear 2 are slidable relative thereto for adjusting the pump capacity. The lower portion of lower cap 14 projects from external ring 8 and defines, with the walls of cavity 40, a chamber 15 (first adjustment space) which is separated from pumping chambers 11 by lower cap 14. A radial duct 50 ends at chamber 15, said duct opening in a side wall of lower body 102, as shown at 51 in FIGS. 1 and 2, and communicating with the engine for receiving oil under pressure therefrom. In this manner, pressure conditions representative of the pressure actually existing in the engine exist in chamber 15, the pressure in the engine being a first control pressure for the capacity adjustment, intended to act onto bottom part 8A of ring 8 to make the ring slide jointly with external orbital gear 2. Lower cap 14 further has an off-axis hole 16 through which shaft 6 passes.

In its upper part, above internal orbital gear 4, cavity 25 of orbital gear 2 houses a second cap (star-shaped cap) 18 having a toothed lower portion 19, the external surface of which is shaped in complementary manner to the internal surface of external orbital gear 2, and a cylindrical upper portion 20. The latter is received in a cylindrical cavity of a third cap (upper cap) 22. Upper cap 22 is mounted with interference on the upper portion of external orbital gear 2 so as to be rigidly connected thereto for the rotation and the translation, and abuts against a step 9 (FIG. 4) of the side surface of external orbital gear 2. External orbital gear 2 and the mechanism for translating it, consisting of ring 8 and upper cap 22, which are the components exposed to the control pressure, behave therefore as a single adjusting member, which hereinafter will also be referred to as "orbital body".

Figure 3:
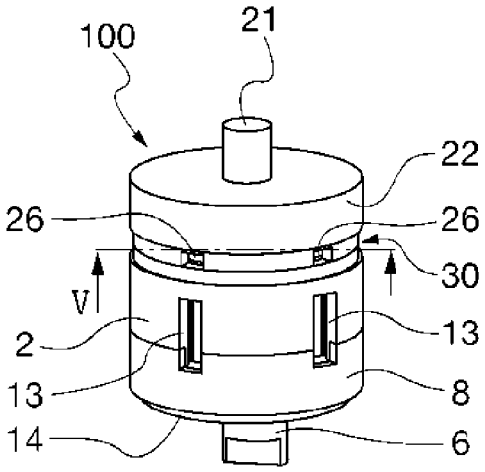
FIG. 3 is a perspective view of the central body of the pump.
Figure 5:
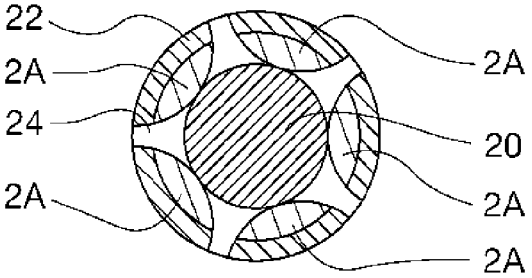
FIG. 5 is a cross-sectional view taken along line V-V of FIG. 3.
Figure 9:
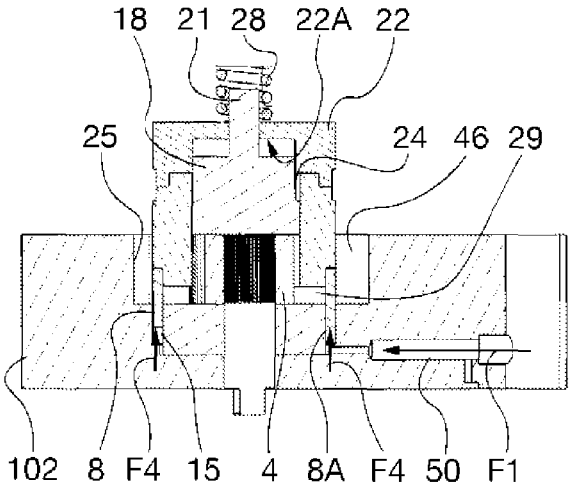
Figure 11:
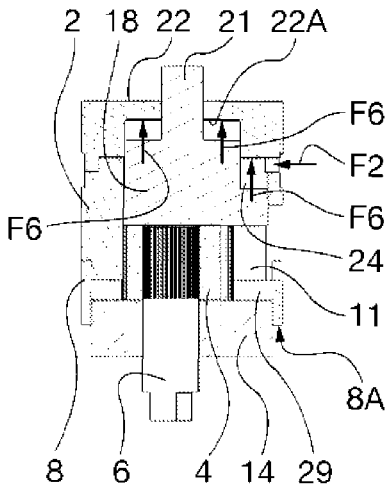

Toothed portion 19 of star-shaped cap 18 is introduced in substantially sealed manner into cavity 25, for instance so that its bottom base is substantially in contact with the top base of internal orbital gear 4, and its top base defines, with the top of the cavity of upper cap 22, a chamber 24 (second adjustment space) communicating with a delivery chamber 48 (FIG. 4) through openings 26 (FIG. 3). Similarly to openings 13, openings 26 are formed by cuts 17, 23 provided on the cooperating edges of external orbital gear 2 and upper cap 22. Therefore, the pressure existing at the delivery side of the pump exists in this chamber 24, and it on top 22A (FIGS. 9, 11) of upper cap 22 and forms a second control pressure for the adjustment of the capacity of pump 1. Openings 26 open into an annular groove 30 formed by recesses of the side surfaces of external orbital gear 2 and upper cap 22.

Upper cap 22 is received in a cavity 60 (FIG. 4) of upper body 104 and is kept pressed against step 9 by spring 28, e.g. a coil spring, which is wound on a shank 21 of star-shaped cap 18. One end of the spring abuts against the top face of upper cap 22, and the other end abuts against the top of an axial cavity of a spring cover 34, fastened on top, of upper body 104. Spring 28 is pre-loaded so as to establish a pressure threshold in chambers 15 and/or 24, such that, when the threshold is exceeded, the orbital body displacement is obtained. Shank 21 penetrates into the cavity of spring cover 34 by passing through an axial hole 32 of upper cap 22 and an axial hole 66 of cavity 60 of upper body 104. Also spring 38 passes through hole 66.

Figure 6:
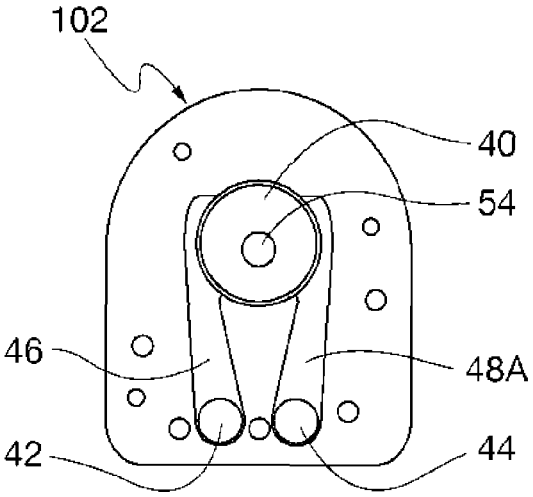
FIGS. 6 and 7 are views of the lower and the upper body, respectively, of the supporting part of the pump, taken from the inside of the pump.
Figure 7:
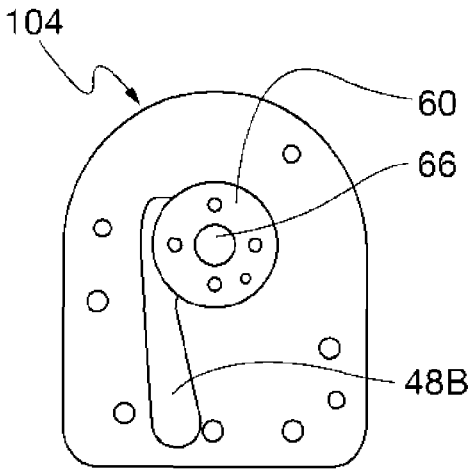
Figure 8:
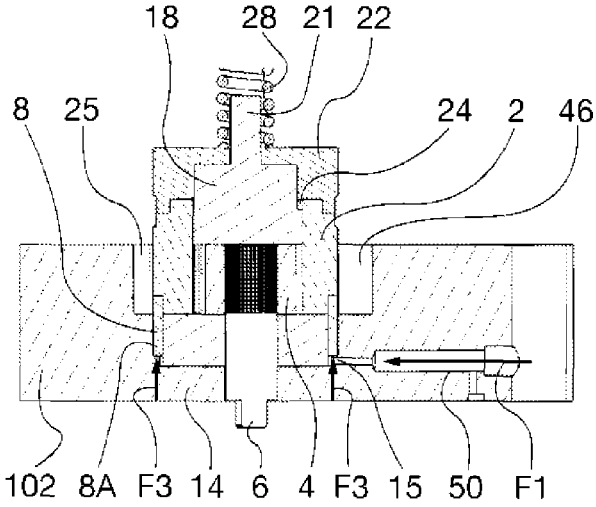
FIGS. 8 and 9 are partial cross-sectional views of the pump, in two different pressure conditions of the oil in the engine.
Figure 10:
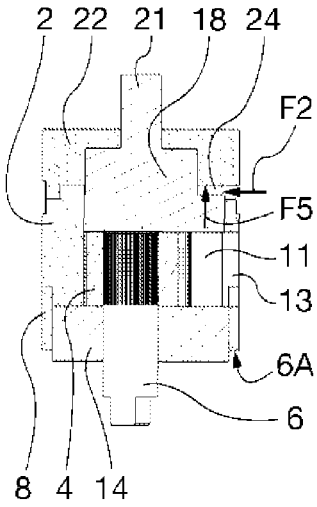
FIGS. 10 and 11 are cross-sectional views of the central body of the pump, in two different pressure conditions at the delivery side of the pump.

Referring also to FIGS. 6 and 7, lower and upper bodies 102 and 104, which are intended to be joined together for instance by screws (not shown), have, on the faces turned towards the inside of the pump, the respective cavities 40 and 60, the depth of which is chosen so as to allow the desired adjustment stroke for the orbital body. Substantially vertical intake and delivery ducts 42 and 44, communicating with cavity 40 through hollows 46, 48A in the top face of lower body 102, are formed in body 102 near one edge. Hollow 46 that, in assembled condition of the pump, is closed upwards by the bottom surface of upper body 104 forms the intake chamber. Hollow 48A forms, together with a complementary hollow 48B in the tower surface of upper body 104, delivery chamber 48. The different heights of the intake and delivery chambers 46 and 48 are due to the fact that intake chamber 46 is to communicate with chambers 11 (FIG. 4) only, whereas delivery chamber 48 is also to communicate with chamber 24.

The operation of the pump according to the invention will now be described, referring also to FIGS. 8 to 11. There, double-line arrows denote oil inlets, single-line arrows denote oil pressures above the threshold established by spring 28, and dotted line arrows denote pressures below the threshold.

In conventional manner, the torque transmitted by shaft 6 is applied to internal orbital gear 4 that, by rotating, makes the external orbital gear rotate, thereby allowing the pump to convey from intake chamber 46 to delivery chamber 48 oil sucked from the sump and compressed because of the passage through the different chambers 11. Oil under pressure arrives from the motor into chamber 15 between ring 8 and the bottom of cavity 40, as shown by arrow F1 in FIGS. 8 and 9. Moreover, oil under pressure passes also from delivery chamber 48 to chamber 24 between upper cap 22 and star-shaped cap 18, as shown by arrow F2 in FIGS. 10 and 11.

At low rotation speeds of the engine (FIG. 8), the oil pressure in the engine, acting onto external ring 8 (arrows F3), is not sufficient to overcome the resistance of spring 28. The latter keeps external orbital gear 2 in contact with lower cap 14, so that chambers 11 (FIG. 4) have their maximum volume and determine the maximum capacity conditions for pump 1. When the pressure acting onto bottom edge 8A of ring 8 increases due to an increase in the number of revolutions of the engine and exceeds the threshold established by the preloading of spring 28 (arrows F4 in FIG. 9), the orbital body is displaced towards upper body 104 and the capacity decreases because of a reduction in the height of pumping chambers 11. Moreover, because of that movement, a secondary chamber 29 is formed between external orbital gear 2 and lower cap 14 and creates a condition of hydraulic short-circuit or oil recirculation between intake chamber 46 and delivery chamber 48. The short-circuit condition results in a pressure decrease tending to reset the pump to the starting conditions shown in FIG. 8.

The delivery pressure of the pump present in chamber 24 determines operating conditions similar to those described above. Under regular operating conditions, the pressure in chamber 24 is not sufficient to overcome the force exerted by spring 28 (arrow F5, FIG. 10): hence, external orbital gear 2 is in contact with lower cap 14 and pump 1 operates at its maximum capacity. An increase of the oil delivery pressure above a given pressure threshold (arrows F6 in FIG. 11) makes upper cap 22 move away from star-shaped cap 18. Consequently, also external orbital gear 2 moves away from lower cap 14, thereby determining the condition of hydraulic short-circuit through chamber 29, as described above.

In both cases, while the orbital body is displacing, internal orbital gear 4 always meshes with external orbital gear 2, thereby ensuring the pump operation.

It is clear that the invention allows attaining the desired objects. Actually, the translational movement of the orbital body, and hence the possible reduction in the capacity of pump 1 and in the oil flow rate, is controlled by the oil pressure in two spaces 15 and 24, which are in communication with two different points of the lubrication circuit, namely the engine and the delivery side of the pump. Hence, on the one hand, through the pressure signal sent to the pump through duct 50, it is the engine itself that requires of the pump the oil flow rate actually necessary for the operating conditions existing at a given instant. On the other hand, a pressure increase occurring upstream the main control channel of the engine, for instance due to a filter obstruction or in case of a cold start, is converted into an overpressure in the delivery channel which, once the safety threshold is exceeded, brings the pump to hydraulic short-circuit or oil recirculation conditions, thereby avoiding damages to the engine because of an insufficient lubrication.

Moreover, the flow rate adjustment is obtained by directly acting on the slidable member, and not indirectly, by means of a piston which in turn pushes the slidable member: hence the structure is simpler and the response is faster.

Figure 12:
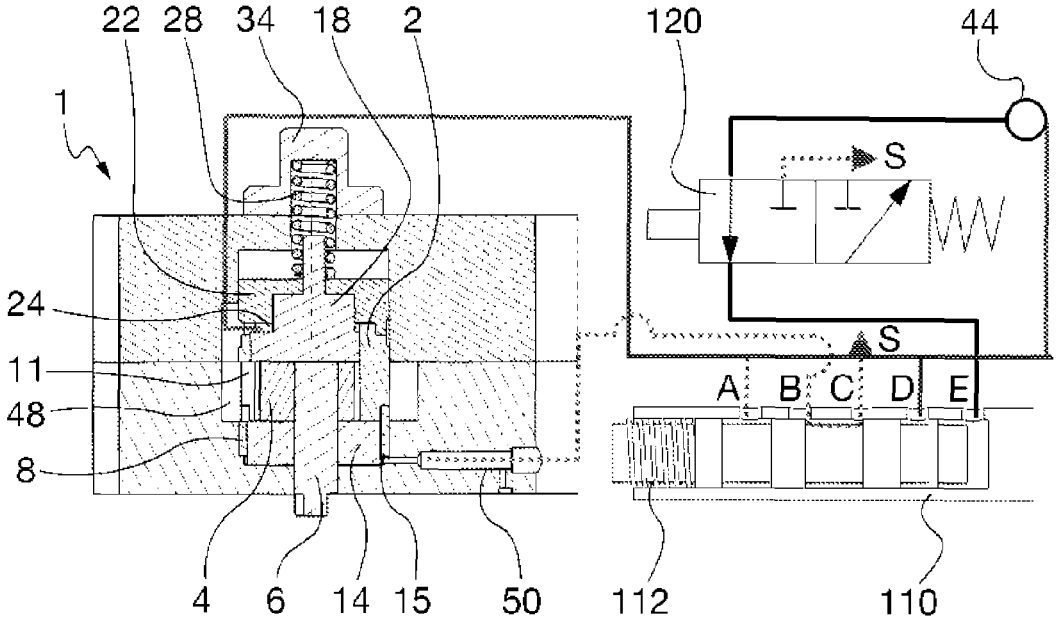
FIGS. 12 and 13 are diagrams relating to the pump control by means of an external valve, and show the pump in conditions of maximum capacity and reduced capacity, respectively.
Figure 13:
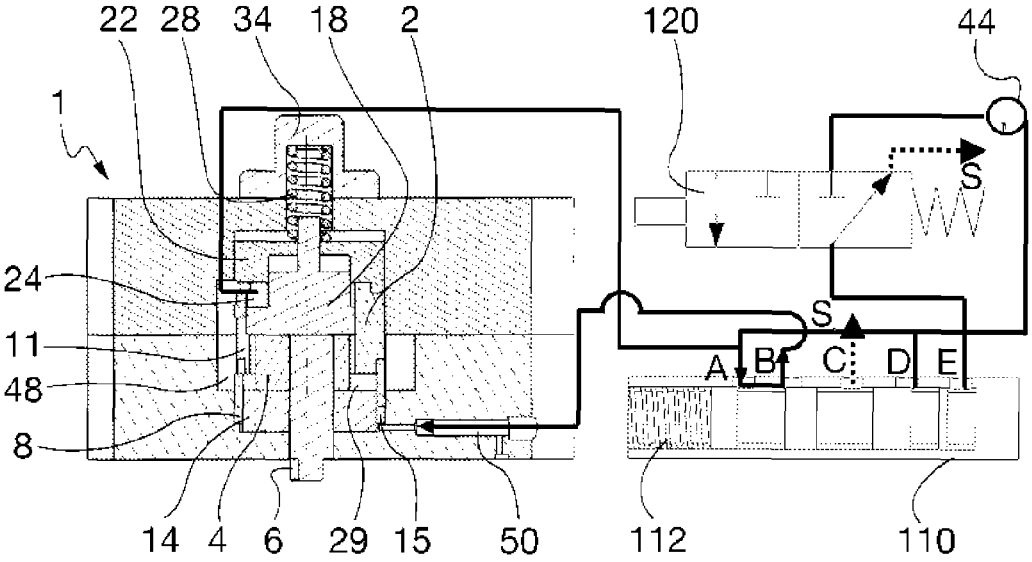

FIGS. 12 and 13 schematically show the use of pump 1 according to the invention in engines where the flow rate of the lubrication oil is determined by an external management logic in response to the oil pressure in the engine, or more generally in response to the overall operating conditions of the engine (oil pressure and temperature, rotation speed . . . ). The structure of pump 1 is as shown in FIGS. 1 to 11. For sake of clarity, delivery duct 44 is shown also outside pump 1. Solid lines denote paths of oil under pressure, and dotted lines the discharge of leaks, if any, denoted by S.

In such a configuration, delivery duct 44 is connected to a port (port D) of a distribution valve 110, for instance a slide valve driven by a control unit 120, e.g. a solenoid valve, electrically operated so as to change its state depending on the operating conditions of the engine, detected by suitable sensors (not shown). In particular, solenoid valve 120 takes a first or a second state corresponding to the pump operation at the maximum capacity (and maximum flow rate) and to the capacity adjustment to a value below the maximum, respectively, and consequently it makes distribution valve 110 take a first and a second state.

In the first state of both valves, shown in FIG. 12, distribution valve 110 receives oil from duct 44 also at a second port (port E) through solenoid valve 120, and this oil moves the valve slide to a forward position against the action of spring 112. Under such conditions, duct 50 is not fed with oil under pressure, but it only collects leaks through the pump, if any, which are then discharged towards the oil sump through ports B and C of distribution valve 110. Port A also only collects leaks, if any, to be discharged towards the pump. Spring 28 contrasting the orbital body is suitably set so that the presence of oil only in chamber 24 of pump 1 is not sufficient, under regular operating conditions of the engine and the pump, to overcome the resistance of spring 28, so that external orbital gear 2 abuts against lower cap 14.

In the second state, shown in FIG. 13, solenoid valve 120 closes the oil passage towards distribution valve 110, so that port E is not fed. The valve then returns to a rest condition, in which the whole of the oil arrives in chamber D and is partly sent also to chamber 15 through ports A and B and duct 50. The presence of oil under pressure in both chambers 15 and 24 makes the overall pressure applied to the orbital body overcome the resistance of spring 28 and cause the displacement of the orbital body, thereby creating recirculation chamber 29.

It is to be appreciated that in both states an overpressure, if any, in pump delivery chamber 48 due to any operation irregularity will cause the displacement of external orbital gear 2, independently of the valve-conditions.

Also such a configuration maintains the safety characteristics related with a control of the capacity variation based on two different pressures.

It is clear that the above description has been given only by way of non limiting example and that changes and modifications are possible without departing from the scope of the invention.

For instance, even if the drawings show an orbital body comprising three separate elements 2, 12 and 22 rigidly connected together for rotation and translation for instance thanks to an interference mounting, the orbital body could be a single body suitably shaped so as to form external orbital gear 2 and to define both spaces 15 and 24 causing the translational movement of the orbital body.

Moreover, even if it has been assumed that internal orbital gear 4 is rotated by the shaft and external orbital gear 2 is slidable on the internal orbital gear in order to vary the pump capacity and forms the member distributing the fluid from intake chamber 46 to internal chambers 11 of the pump and from such chambers to delivery chamber 48, it is self-evident that the tasks of the two orbital gears could be mutually exchanged, even if the described solution is preferable for sake of constructional simplicity.

Further, even if the invention has been disclosed with reference to its application to a pump, the embodiment shown in FIGS. 1 to 11 can be employed also in a machine used as a motor, which receives a fluid at high pressure through duct 44 and discharges the fluid at a lower pressure through duct 42. However, in the operation as a motor, the possible variation of the displacement is determined only by the pressure in the first space 24.

Advantageously, openings 13 defined by cuts 10 and 12 can be made with sizes that can be suited to the constructional preferences. Consequently, it is possible to freely dimension the cross-sectional sizes of openings 13 so as to avoid cavitation problems in the pump.

Another advantage is that the displacement can be increased by increasing the radial sizes of external orbital gear 2, internal orbital gear 4 and toothed portion 19 of star-shaped cap 18. Thus, the increase in the displacement does not negatively affect the axial size of the pump.

Of course, the pump or the motor could be pneumatic machines instead of hydraulic machines. Also, the individual elements described here can be replaced by functionally equivalent elements.

The invention claimed is:

1. A fluidic machine with gears, comprising a supporting part where there are formed a low pressure chamber and a high pressure chamber communicating with low pressure and high pressure sections, respectively, of a fluidic circuit in which the machine is connected, and an operating part for transferring a fluid between said low pressure and high pressure chambers, the operating part being mounted within the supporting part and including in turn:

an external gear, arranged to rotate about a first axis and having an internal toothing with a first number of teeth; and an internal gear, which is housed within an axial cavity of the external gear, is arranged to rotate about a second axis different from the first axis and has an external toothing with a second number of teeth, arranged to mesh with the internal toothing of the external gear with only partial fluid seal, the teeth of both gears defining fluid chambers the volume of which changes during rotation and through which the fluid is transferred from a machine inlet connected to one of the low pressure and high pressure chambers to a machine outlet connected to the other one of the low pressure and high pressure chambers;

wherein one of the internal and external gears is mounted in an axially fixed position and the other gear is associated with a translating mechanism, arranged to cause an axial sliding thereof relative to the gear mounted in the axially fixed position in order to vary the machine capacity by changing the axial extension of an area over which the teeth of both gears mesh, and wherein the translating mechanism defines a first capacity adjustment space in communication with the high pressure chamber and is arranged to slide in response to first pressure conditions existing in the first capacity adjustment space in order to make the axially slidable gear slide, wherein the translating mechanism further defines a second capacity adjustment space where second pressure conditions exist that are dependent on operating conditions of an element of the fluidic circuit different from the high pressure chamber of the machine, the translating mechanism being axially slidable in the supporting part either in response also to the pressure conditions existing in the second capacity adjustment space, or in response to a combination of the pressure conditions existing in the first and second capacity adjustment spaces;

said external gear and said translating mechanism are arranged to define radial oriented openings for fluid inlet/outlet into/from said fluid chambers in order to obtain a radial feed of said fluidic machine; and wherein said translating mechanism comprises an external ring which is rigidly connected for the rotational and translational movements to said external gear.

2. The machine as claimed in claim 1, wherein at the coupling region of said external gear and said ring, the edge of said external gear being provided with cuts and the edge of said ring being provided with respective cuts; said cuts defining said radial oriented openings.

3. The machine as claimed in claim 2, wherein said external ring is connected to said external gear by means of an interference fit.

4. The machine as claimed in claim 3, wherein said external ring is connected on the bottom end of said external gear.

5. The machine as claimed in claim 4, wherein said external ring abuts against a step of the surface of said external gear.

6. The machine as claimed in claim 1, wherein the machine is a pump connected in the lubrication circuit of an engine of a motor vehicle, and the first capacity adjustment space is in communication with a delivery side of the pump.

7. The machine as claimed in claim 1, wherein the axially slidable gear is rigidly connected to or is formed as an integral body with the translating mechanism, and the first capacity adjustment space is a chamber formed internally of the translating mechanism.

8. The machine as claimed in claim 2, wherein the axially slidable gear is rigidly connected to or is formed as an integral body with the translating mechanism, and the first capacity adjustment space is a chamber formed internally of the translating mechanism.

9. The machine as claimed in claim 6, wherein the axially slidable gear is rigidly connected to or is formed as an integral body with the translating mechanism, and the first capacity adjustment space is a chamber formed internally of the translating mechanism.

10. The machine as claimed in claim 7, wherein the translating mechanism further includes a first closing body at a first axial end, and in that the chamber forming the first capacity adjustment space is defined between the first closing body, the walls of the axial cavity of the slidable gear and a body closing said cavity, which body is arranged in an axially fixed position in the same cavity and has, over part of a side surface, an external toothing complementary with the toothing of the slidable gear and arranged to sealingly mesh with such a toothing in order to separate the fluid chambers from the first capacity adjustment space while enabling the sliding of the slidable gear for the capacity adjustment.

11. The machine as claimed in claim 10, wherein the translating mechanism has, at an end opposite to the first closing body, an external ring where a second closing body is received in an axially fixed position, and in that the second capacity adjustment space is defined between an edge of the external ring, the second closing body and the walls of a cavity formed in the supporting part and receiving such an external ring and the second closing body.

12. The machine as claimed in claim 11, wherein the second closing body is arranged, in a rest position of the translating mechanism determining a maximum capacity of the machine, to abut against an adjacent end of the slidable gear and is arranged, in positions of the translating mechanism translated relative to the rest position, to define, together with such an end of the slidable gear and the external ring of the translating mechanism, a secondary chamber establishing a fluidic short-circuit between the low pressure chamber and the high pressure chamber.

13. The machine as claimed in claim 1, wherein the second capacity adjustment space is arranged to receive pressurised lubrication fluid sent back from an engine to the fluidic machine, and the translating mechanism is arranged to make the slidable gear slide when the pressure of the lubrication fluid in the first or the second capacity adjustment space exceeds a given threshold.

14. The machine as claimed in claim 2, wherein the second capacity adjustment space is arranged to receive pressurised lubrication fluid sent back from an engine to the fluidic machine, and the translating mechanism is arranged to make the slidable gear slide when the pressure of the lubrication fluid in the first or the second capacity adjustment space exceeds a given threshold.

15. The machine as claimed in claim 6, wherein the second capacity adjustment space is arranged to receive pressurised lubrication fluid sent back from the engine to the pump, and the translating mechanism is arranged to make the slidable gear slide when the pressure of the lubrication fluid in the first or the second capacity adjustment space exceeds a given threshold.

16. The machine as claimed in claim 1, wherein the machine is a pump and is associated with an external management logic establishing the capacity of the pump, and hence the flow rate of the lubrication fluid, depending on the operating conditions of an engine, and in that:

the delivery side of the pump is connected to a pressurised fluid distribution valve associated with a control body which is controlled by the external management logic and is arranged to set the distribution valve in a first operating condition, when the pump is to operate at maximum capacity, or in a second operating condition, when the capacity of the pump is to be changed; and the second capacity adjustment space is in communication, through the distribution valve, with either a low pressure point of the lubrication circuit, in the first condition of the distribution valve, or the delivery side of the pump, in the second condition of the distribution valve.

17. A method of varying the capacity of a fluidic machine with gears including an external gear, arranged to rotate about a first axis and having an internal toothing with a first number of teeth, and an internal gear, which is received in an axial cavity of the external gear, is made to rotate about a second axis different from the first axis and has an external toothing with a second number of teeth meshing with the internal toothing of the external gear with only partial fluid seal, the teeth of both gears defining fluid chambers the volumes of which change during rotation and through which a fluid is transferred from a machine inlet to a machine outlet, the method including the steps of:

creating a first capacity adjustment space in communication with a high pressure chamber of the machine;

making one of the gears slide relative to the other, in response to first pressure conditions existing in the first capacity adjustment space, in order to change the axial extension of an area over which the teeth of both gears mesh;

creating a second capacity adjustment space;

establishing in the second capacity adjustment space second pressure conditions that are dependent on operating conditions existing in an element, different from the high pressure chamber, of a fluidic circuit in which the machine is connected;

making the axially slidable gear slide either in response also to the pressure conditions existing in the second capacity adjustment space, or in response to a combination of the pressure conditions existing in the first and second capacity adjustment spaces; and making said fluid transfer into/from said fluid chambers from said machine inlet/to said machine outlet through radial oriented openings defined by said external gear and said translating mechanism, so as to obtain a radial feed of said fluidic machine; and wherein said fluidic machine further comprises an external ring rigidly connected for the rotational and translational movements to said external gear.

18. The method as claimed in claim 17, wherein the step of making said fluid transfer into/from said fluid chambers is performed by making said fluid to pass through cuts provided at the edge of said external gear and respective cuts provided at the edge of said external ring, said cuts being provided at the coupling region of said external gear and said ring and defining said radial oriented openings.

19. The method as claimed in claim 17, wherein the fluidic machine is a pump connected in the lubrication circuit of an engine of a motor vehicle, and in that the step of establishing second pressure conditions in the second capacity adjustment space is performed either by sending back pressurised lubrication fluid from the engine to such a second space, or by connecting the second space to either a low pressure point of the lubrication circuit, if the operating conditions of the engine demand a maximum capacity of the pump, or a delivery side of the pump, if the operating conditions of the engine demand a capacity of the pump lower than the maximum capacity.

20. The method as claimed in claim 18, wherein the fluidic machine is a pump connected in the lubrication circuit of an engine of a motor vehicle, and in that the step of establishing second pressure conditions in the second capacity adjustment space is performed either by sending back pressurised lubrication fluid from the engine to such a second space, or by connecting the second space to either a low pressure point of the lubrication circuit, if the operating conditions of the engine demand a maximum capacity of the pump, or a delivery side of the pump, if the operating conditions of the engine demand a capacity of the pump lower than the maximum capacity.

* * * * *